US006533480B2

(12) United States Patent
Schneider

(10) Patent No.: US 6,533,480 B2
(45) Date of Patent: Mar. 18, 2003

(54) ADJUSTABLE FINGER STYLUS

(76) Inventor: Marc L. Schneider, 14 Davey Dr., West Orange, NJ (US) 07052

( * ) Notice: Subject to any disclaimer, the term of this patent is extended or adjusted under 35 U.S.C. 154(b) by 0 days.

(21) Appl. No.: 09/879,507

(22) Filed: Jun. 12, 2001

(65) Prior Publication Data

US 2001/0053306 A1 Dec. 20, 2001

Related U.S. Application Data

(60) Provisional application No. 60/211,370, filed on Jun. 14, 2000.

(51) Int. Cl.[7] ..... A46B 5/02
(52) U.S. Cl. ..... 401/8; 401/258
(58) Field of Search ..... 401/8, 258, 6, 401/48, 7; 224/267

(56) References Cited

U.S. PATENT DOCUMENTS

| | | | | |
|---|---|---|---|---|
| 1,444,982 A | | 2/1923 | Orth | |
| 2,921,590 A | | 1/1960 | Holton | 132/84 |
| D212,981 S | | 12/1968 | Laybourne | D74/17 |
| 3,505,700 A | * | 4/1970 | Rodriguez | 401/8 |
| D217,745 S | | 6/1970 | Silson | D86/13 |
| D246,904 S | | 1/1978 | MacIntosh | D19/41 |
| 4,127,338 A | | 11/1978 | Laybourne | 401/8 |
| D253,416 S | | 11/1979 | MacIntosh | D19/41 |
| 4,738,556 A | | 4/1988 | Brown | 401/7 |
| 5,391,010 A | * | 2/1995 | Gorbunov | 401/8 |
| 5,453,759 A | | 9/1995 | Seebach | 345/158 |
| 5,529,415 A | | 6/1996 | Bishop | 401/7 |
| 5,706,026 A | | 1/1998 | Kent et al. | |
| 5,885,018 A | | 3/1999 | Sato | 401/8 |
| D418,494 S | | 1/2000 | Robb | D14/114 |
| 6,075,189 A | | 6/2000 | Robb | 84/322 |
| 6,225,988 B1 | | 5/2001 | Robb | 345/179 |
| 6,249,277 B1 | * | 6/2001 | Varveris | 401/8 |

FOREIGN PATENT DOCUMENTS

| | | |
|---|---|---|
| JP | 11134103 | 5/1999 |

* cited by examiner

*Primary Examiner*—David J. Walczak
(74) *Attorney, Agent, or Firm*—Lerner, David, Littenberg, Krumholz & Mentlik, LLP

(57) ABSTRACT

An adjustable and economical finger stylus useful in operating a touch sensitive screen and for entering data in, e.g., a personal data assistant (PAD). The adjustable elements of the finger stylus provide for rapid, convenient and significant adjustability while comfortably securing the stylus to the finger during use. Once sized, the stylus can readily be slipped on and off the user's finger as needed.

22 Claims, 6 Drawing Sheets

ADJUSTABLE FINGER STYLUS

CROSS-REFERENCE TO RELATED APPLICATIONS

The present application claims benefit of U.S. Provisional Application No. 60/211,370, filed Jun. 14, 2000, the disclosure of which is hereby incorporated by reference herein.

BACKGROUND OF THE INVENTION

The present invention relates to a stylus tool for use with touch-sensitive electronic screens such as a personal data assistant ("PAD") as well as other computer and data entry equipment. Typically, a PAD is portable and includes functions that permit it to perform as a computerized personal organizer. It utilizes a pen-like stylus in combination with a computerized touch screen for inputting data. The writing end or tip of the stylus allows the user to point and touch, as well as to write individual letters and numbers into an input field on the PAD without the use of a pen, pencil or other type of marking instrument.

A typical first generation PAD allowed users to carry a small battery operated computer device to keep addresses, maintain a scheduling calendar, perform calculator functions, and keep a "to-do" list. Second generation PDAs include such further features as access to the Internet, functioning as a cellular telephone, performing complex computer functions such as spreadsheet applications and other computer software, and playing digital music. The potential for these portable and lightweight devices is expanding and future developments are said to include video cameras, video cellular telephones, digital cameras, garage and television remote controls, etc.

A PAD is typically designed to include a holder for a pen-like stylus that can be removed for use from an opening in the PAD housing. However, the pen-like stylus is subject to being lost, e.g., when the user forgets to replace it in the housing, and a replacement stylus must be obtained. It is preferable that a replacement stylus, or the original equipment stylus, be inexpensive, compact, portable, comfortable and easy to use, so that a user can own several, and carry one or more for convenience. The improvement required is a stylus that is compact, inexpensive, comfortable and easy to use.

The typical stylus currently available commercially for use with a PAD is a smooth tipped pen-like device designed to be held in the hand as one would hold a pen or pencil. It allows a user to input data by touching an interactive screen, pointing, and/or writing numbers and letters. Typically, a PAD computer device includes such a writing stylus. Additionally, after-market variations of the pen-like design also have been marketed.

Also available is a type of finger stylus. For example, one such "finger-tip stylus" has been advertised for sale on the Internet by Concept Kitchen, Inc. This device is made of easily bendable metal and is designed to fit over the top of the finger tip. It includes two tabs that are bent down so as to squeeze against the sides of the finger tip in order to secure the device to the finger. Since the tabs are easily bent, subsequent use or storage, e.g., when carried in the user's pocket or purse, subjects the tabs to inadvertent bending, leading to a need to resize it upon each use. Eventually, the tabs are subject to breaking from repeated bending.

U.S. Pat. No. 2,921,590 discloses a disposable and dispensable tooth brush that can be attached via adhesive strips to the base of a finger, wherein the bristles are disposed on the base of the device corresponding to the lower, or fingerprint surface of the finger.

U.S. Pat. No. 4,738,556 discloses a finger-mounted ball point pen incorporating various padding elements for the comfort of the user. It also discloses the use of a large strap element including hook and loop material for securing the device to the finger by wrapping around a substantial portion of the user's finger.

U.S. Design Pat. No. D418,494 illustrates a split ring design for a finger-tip stylus. The split ring shaped portion is required to flex in order to meet the variations in human index finger size. Such an arrangement is limited in that a small index finger is fit too loosely, rendering the product useless as a writing stylus, whereas a large index finger is unduly pressured, making the user uncomfortable. Additionally, the illustrated structure results in the user's cuticle and fingernail being covered, making it uncomfortable during long periods of use. Furthermore, a user having long fingernails, or even fingernails that protrude only slightly beyond the fleshy tip of the finger will be uncomfortable or unable to use this type of fingertip stylus structure.

U.S. Pat. No. 6,075,189 also employs a split ring member to attach a finger stylus and is subject to the same limitations discussed above with regard to D418,494. In the '189 patent the tip end is removable in order to facilitate the use of various size tip members.

Similar split ring structures can be found in U.S. Design Pat. Nos. D253,416; 246,904; 217,745; and 212,981; as well as in U.S. Pat. Nos. 4,127,338 and 5,885,018 that apply such a structure to a pen or pencil. Additionally, U.S. Pat. No. 1,444,982 applies the split ring structure to a pick for musical instruments. FIG. 2 of the '982 patent is strikingly similar to the structure disclosed in U.S. Design Pat. D418,494 and FIG. 1 of U.S. Pat. No. 6,225,988. The latter patent, a continuation-in-part of U.S. Pat. No. 6,075,189 discussed above, also discloses a split ring structure.

U.S. Pat. No. 5,529,415 discloses a pen which is attached to a shroud-like finger tip portion that fits completely over the finger tip and is incapable of size adjustment. A similar structure is disclosed in U.S. Pat. No. 5,453,759 that also incorporates electronic components in the tip member for use in interacting with a computer system.

Japanese patent abstract publication number 11134103A discloses a split ring finger stylus designed to fit on the top surface of the finger. It includes an extension or pointing element attached to the top surface of the ring for touching a computer screen.

Further improvements for fingertip styli are required to improve their universal fit at a reasonable cost, while simultaneously improving comfort and portability.

SUMMARY OF THE INVENTION

An adjustable finger stylus comprising: (a) a longitudinal element parallel to and in touching contact along a lower surface portion of the length of the finger extending back from the tip of the finger, wherein the longitudinal element curves upwardly from the lower portion adjacent the finger tip end and terminates proximate the finger nail; (b) the longitudinal element including at least one adjustable finger engaging element integral the longitudinal element and extending outwardly therefrom in order to secure the stylus to the finger; and (c) a tapered writing extension extending longitudinally from the end of the curved element and forward the finger nail.

In a preferred embodiment, the adjustable finger engaging element comprises one arm extending outwardly from each side of the longitudinal element and including as engaging means either (1) hook or loop material or (2) studs or holes in each of the arms so that when the arms are wrapped over the top of the finger in overlapping fashion and engaged, a ring-like structure is formed that secures the stylus to the finger. The use of hook and loop material or studs and holes provides for convenient and significant adjustability of the finger stylus while comfortably securing the stylus to the finger during use.

DETAILED DESCRIPTION

Figure 1:
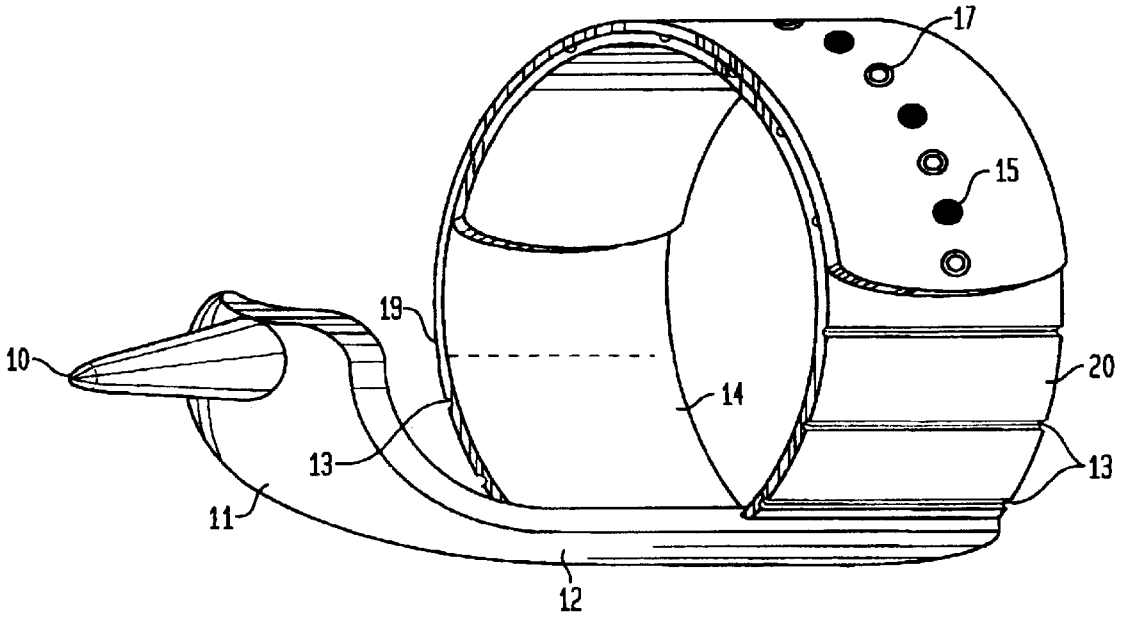
FIG. 1 is a perspective side view of a preferred embodiment of the invention with two bands joined to form an overlapping ring-like structure suitable for engagement around a finger.

Referring now to the drawings, a preferred embodiment of the adjustable finger stylus of the present invention is illustrated and generally indicated in FIGS. 1–6. The stylus tip, located at 10 in all figures, is used for "writing" or inputting information via a touch screen, e.g., as employed in combination with a PAD or other electronic computer device. The tip preferably has a smooth rounded end that is compatible with such touch sensitive screens.

Figure 3:
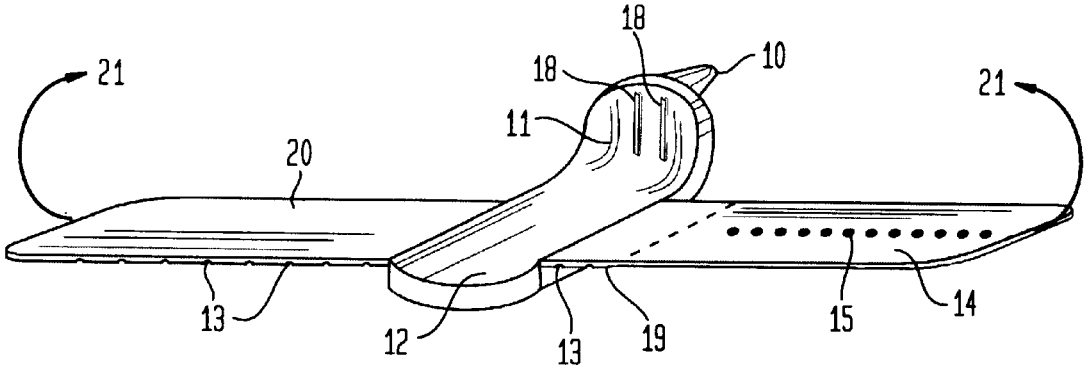
FIG. 3 is a back elevational view of FIG. 1 with the bands disengaged.

The stylus tip is preferably attached to the front end of a substantially rigid curved element located at 11 in all figures. For purposes of the present invention, "substantially rigid" denotes that the identified element, while rigid, is capable of some flexibility if grasped and bent by hand, but is sufficiently rigid so as to permit touch screen operation without undue bending of the stylus tip and/or the element to which such tip is attached, where such bending would interfere with its convenient use as a stylus. In use, the user's finger to which the stylus is to be attached, e.g., the index finger, is placed onto the upper surface of 12 (as illustrated in FIG. 3) so that the tip end of the index finger is in proximate touching contact with the inside curve 11 as more clearly shown in FIG. 3. The curvature of 11 facilitates comfortable contact of the stylus to the finger. Located at 18 in FIG. 3 are ridges that protrude from the inner radius of the curved surface of 11. These ridges, which can be any type of protrusion, including vertical as illustrated, horizontal or at an angle to the vertical or horizontal, or a combination thereof, provide a gripping surface so that undesired movement, e.g., lateral movement, of the finger stylus is inhibited during writing or data input. The height of curved element 11 can be chosen to accommodate the flesh portion of a majority of the human population's index finger without interfering with a protruding fingernail. Preferably, the highest point at the end of element 11, proximate the fingertip, is just below the fingernail. It is within the scope of this invention to adjust the curvature and rise of element 11 to suit specific population segments, e.g. children, teenagers, and adults, as well as those who may use the adjustable finger stylus with a gloved hand, e.g. nurses, paramedics, surgeons, etc.

Element 12 in each figure, extends along the length of a user's finger, and is also slightly curved, as illustrated, so as to comfortably wrap underneath and along the lower surface of a user's finger. The length of element 12 is not critical and can be selected so as to be comfortable for use with each of the population segments noted above, or of an average length suitable for a majority of the members of such groups. Preferably, the rearward end of 12 terminates prior to the second knuckle of the index finger (using as a reference or starting point the tip end of the finger); more preferably it terminates between the first and second knuckle. For example element 12 usefully can be from about 0.5 to about 1.0 inch long; preferably from about 0.6 to about 0.9 inches; more preferably from about 0.7 to about 0.8 inches; for example, about 0.75 inches long. The overall length of both elements 11 and 12 can be from about 1.2 to about 1.75 inches; preferably from about 1.25 to about 1.6 inches; more preferably from about 1.3 to about 1.5 inches; for example, about 1.375 inches in length. The thickness of element 12 is not critical provided that it is substantially rigid. Similarly, its width is not critical, but preferably it is sufficiently wide so that the finger rests comfortably in the concave region; for example, from about 0.2 to about 0.75 inches wide; preferably from about 0.25 to about 0.6 inches; more preferably from about 0.3 to about 0.5 inches; for example, about 0.375 inches wide at the position where the engaging elements or side bands meet element 12. Both 11 and 12 make up a substantially rigid element that preferably is curved in two dimensions, i.e., back-to-front, rising up at the front or finger tip end, and side-to-side forming a concave or bowl-like structure in which the lower surface of the finger is rested, as illustrated in FIGS. 1 and 3. As noted above, these combined elements of the stylus offer only limited flexibility, which is preferred in order to maintain accuracy in transferring the motion of the user's index finger to the end of the stylus tip when inputting information into a touch screen.

Figure 2:
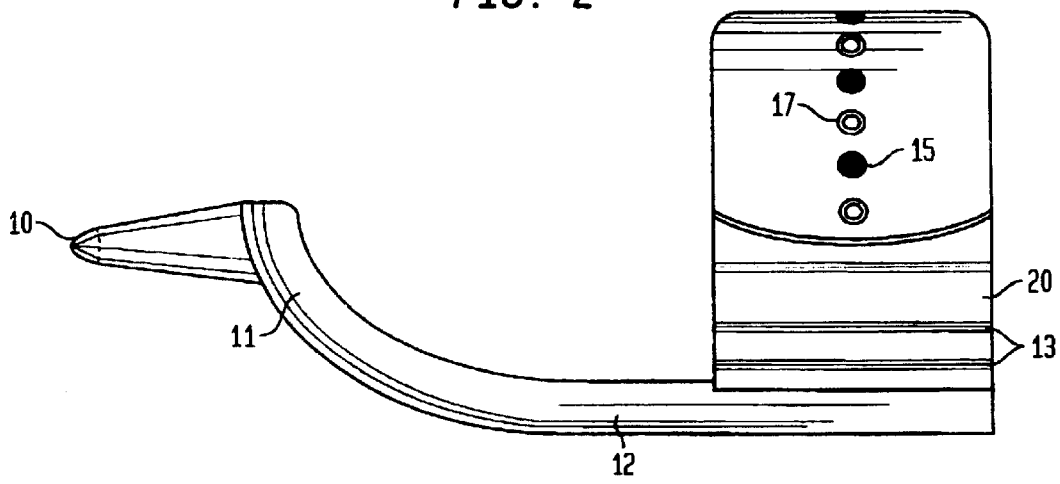
FIG. 2 is a side view of FIG. 1.

In order to facilitate attachment of the stylus to a finger (or, more accurately, to secure the stylus to a finger), extending laterally from at least one side of 12 is at least one side band or finger engaging element, 20; FIGS. 1–5 illustrate the use of two side bands, whereas FIGS. 6–10 illustrate the use of one such band. In use, the two side-band embodiment attaches the stylus to the finger by overlapping one of the bands over the other to form a ring structure, as illustrated in FIGS. 1 and 2. The side bands are fixed to one another by various linking or attachment means, selected from the group consisting of studs and receptor holes, material comprising hooks and loops, permanent or semi-permanent adhesive (the latter being of a type that is capable of holding the two surfaces together during engagement of the arms, but which can be readily pulled apart by hand and subsequently re-engaged if desired, e.g., of the type use on adhesively removable notepaper sold under the brand name Post-It®), buttons and holes, snap together elements (e.g., of the type found on clothing, including metal or plastic versions thereof), magnetic strips, angular ridges or teeth formed on and protruding from opposite faces of the engaging surfaces so as to interlock (permanently or temporarily) when engaged, etc. Hook and loop material is available commercially under the brand name Velcro®. Each of the hook and loop material may be added to the appropriate surface of each of the adjustable finger engaging elements as adhesive backed strips or each material may be made integral with the elements at the time of forming. The figures illustrate linking means according to the use of male studs and female receptor holes; as element 17 already engaged in FIG. 1 and FIG. 2 or, prior to engagement, as elements 15 (hole) and 16 (stud) in FIG. 4, FIG. 5 and FIG. 9. However, it is to be understood that any suitable engagement means that secures the stylus to the finger is suitable, including, as discussed, hook and loop material. The methods or structures described above as useful for linking or attaching two side bands to one another, in addition to the use of studs and holes, are illustrated in FIGS. 11A–F as follows: A illustrates hooks at 16 and loops at 15; B illustrates adhesive layers at 15 and 16, and, as described above, such layers can, in one instance comprise a semi-permanent adhesive and in another instance, a permanent adhesive; C illustrates buttons at 16 and holes at 15; D illustrates one component of snap elements at 16 and the other component at 15; E illustrates magnetic strip layers at 16 and 15; and F illustrates angled teeth and ridges at 16 and 15.

When a single band is used, as illustrated in FIGS. 6 through 10, studs 16 can be located at the lower surface of element 12, preferably in a recessed area approximately the thickness of the side band so that the studs, also preferably approximately of a height equal to the thickness of the side band, do not extend beyond the lower surface of 12. To engage the stylus to the finger, the single band is rotated over the top surface of the finger so that it is in contact therewith and the holes in the band are aligned with the studs and pressed together to fix the ring-like structure to the finger with the side band preferably in thickness alignment with the lower surface of 12 as indicated at 23. In this arrangement, it can be more convenient to align the holes with the studs since the studs are not deflected from the vertical by bending, as may occur in the case of the two-band engagement means. As described above, various other engagement means similarly can suitably be employed. The methods or structures described above as useful for linking or attaching a single side band to the stylus, in addition to the use of studs and holes, are illustrated in FIGS. 12A–F as follows: A illustrates hooks at 16 and loops at 15; B illustrates adhesive layers at 15 and 16, and, as described above, such layers can, in one instance comprise a semi-permanent adhesive and in another instance, a permanent adhesive; C illustrates buttons at 16 and holes at 15; D illustrates one component of snap elements at 16 and the other component at 15; E illustrates magnetic strip layers at 16 and 15; and F illustrates angled teeth and ridges at 16 and 15.

Figure 6:
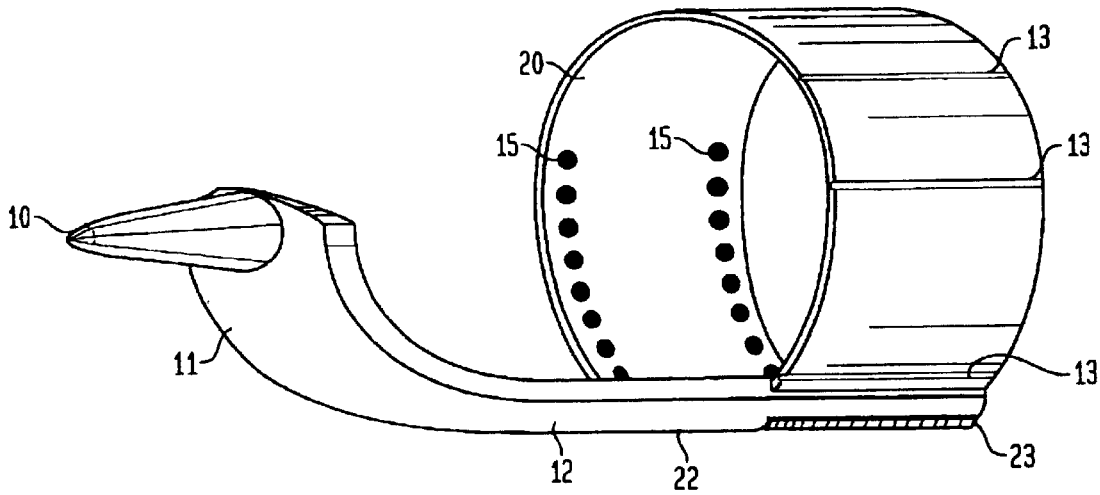
FIG. 6 is a perspective side view of an alternative preferred embodiment of the invention with a single band forming a ring-like structure suitable for engagement around a finger.
Figure 7:
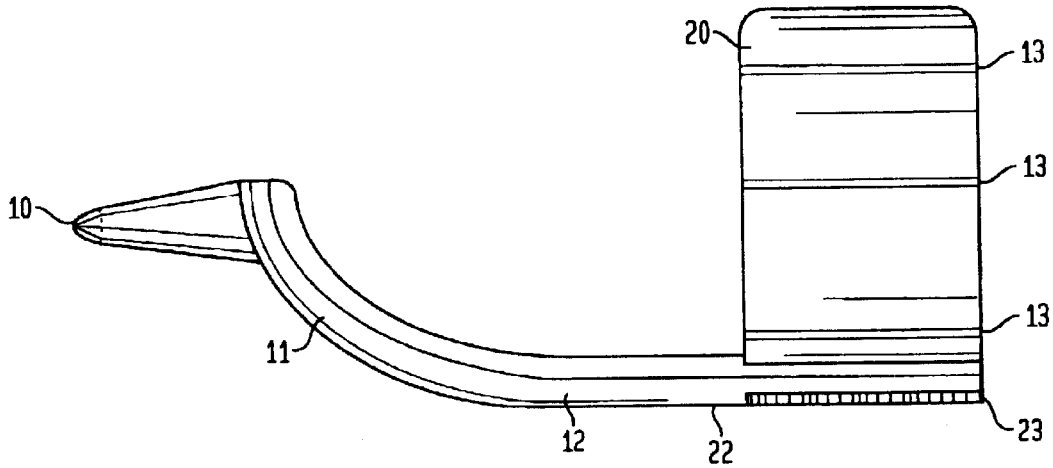
FIG. 7 is a side view of FIG. 6.
Figure 9:
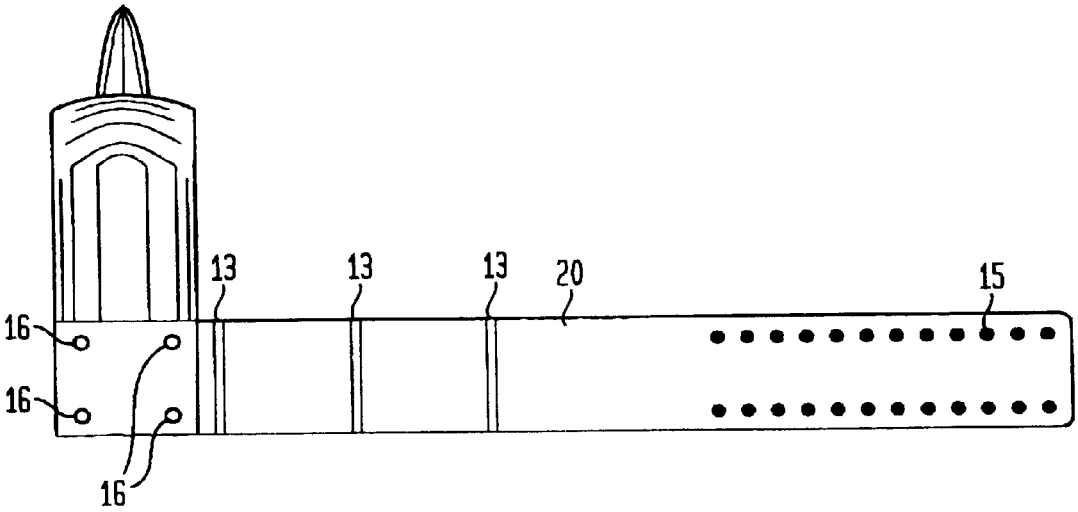
FIG. 9 is a bottom view of FIG. 8.

The length of the band in the single-band embodiment is not critical, but it should be sufficiently long so that its engagement means, e.g., holes, can engage the corresponding engagement element, e.g., studs, located in the embodiment shown in FIG. 9 as elements 16. A single band can usefully extend from the place where it connects to element 12 outwardly, from about 1.5 to about 3.25 inches; preferably from about 1.75 to about 3 inches; more preferably from about 2 to about 2.75 inches; for example such a band can be about 2.5 inches long. If the side band is sufficiently long it may extend beyond the side of 12 when the band is engaged on the finger, but such an extension should not interfere with use of the stylus, particularly if, after sizing the stylus to the user's finger and engaging, e.g., the studs and holes, the unneeded length of the side band is marked, cut and discarded. Similarly, if hook and loop material is used, hook material can be placed in the recessed area of 12 and loop material on the appropriate surface of the side band. After fitting the band to the finger, excess band length is marked so that it can be cut and discarded. In this manner the cut end of the side band can be flush with the side of element 12 (FIGS. 6 and 7 at 22), as illustrated in FIGS. 6 and 7 at 23.

Figure 4:
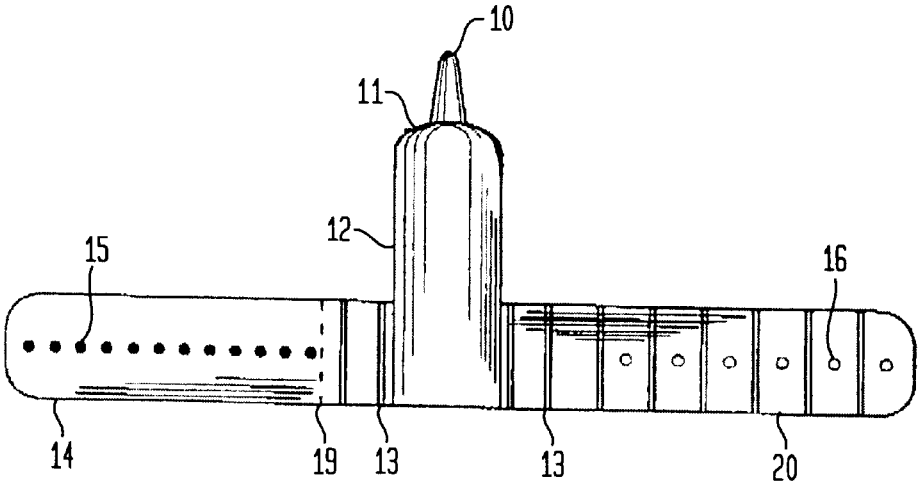
FIG. 4 is a bottom view of FIG. 3.
Figure 5:
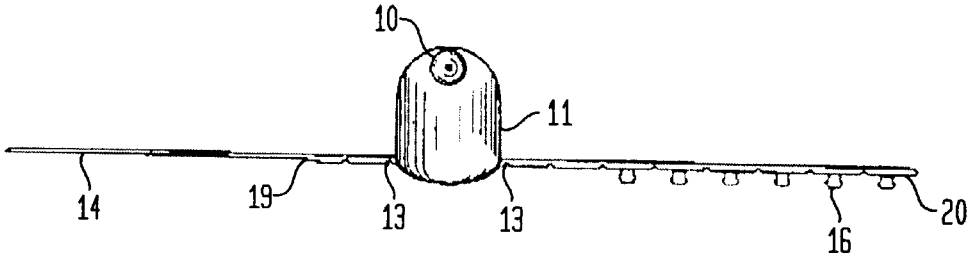
FIG. 5 is a front view of FIG. 3.

On one band are male studs located at 16 in FIGS. 4 and 5. These studs (e.g. mushroom-shaped, although it is acceptable to use any shape known in the art that results in secure engagement), snap into the female receptors, located at 15. The multiple number of female receptors located at 15 in combination with the multiple number of studs allow for a large range of adjustability previously unavailable in a finger stylus. Similarly, the use of hook and loop material (or any of the alternative engagement means described hereinabove) in the dual band or single band arrangement also facilitates convenient adjustment of the stylus. In this manner, the majority of the human population's index finger circumference can be accommodated. When sized and snapped together, indicated at 17, the adjustable finger stylus of FIG. 1 engages the user's index finger. Preferably, the fingernail and cuticle are not covered, providing maximum comfort during long periods of use.

It is particularly preferred that the adjustable stylus of the present invention be molded as a unitary structure. In order to facilitate such molding, plastic or modified plastic compositions can be used, e.g., polyethylene and polypropylene homopolymers and copolymers, elastomeric thermoplastic compositions, etc. Various molding methods well known in the art can be used, including compression and injection molding; injection molding is preferred. Furthermore, the structure can be molded using compositions that include various additives to promote environmental stability against oxidation and ozone as well as fillers and coloring agents to alter the strength, flexibility and appearance of the stylus for improved functionality and customer acceptance.

Although the invention herein has been described with reference to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An adjustable finger stylus comprising:

(a) a longitudinal element having an upper surface adapted to be positioned parallel to and in touching contact along a lower surface portion of a user's finger, said finger further comprising a finger tip end having a finger nail, a base end proximate the palm and digits therebetween, and a top surface incorporating said finger nail and a lower surface opposite thereto and extending back from said finger tip, wherein said longitudinal element further comprises a lower surface opposite said upper surface, wherein said upper surface of said longitudinal element curves upwardly from said lower surface portion of a user's finger adjacent said finger tip and terminates proximate said finger nail thereby forming a curved element;

(b) said longitudinal element further comprising at least one flexible, adjustable finger engaging element integral said longitudinal element and having a free end extending outwardly therefrom, wherein engagement of said free end to said stylus forms a contiguous ring-like structure above said upper surface;

(c) a tapered writing extension extending longitudinally from said curved element and forward said finger nail; and (d) wherein said curved element, said tapered writing extension and said at least one flexible, adjustable finger engaging element are formed as a unitary structure.

2. The adjustable finger stylus of claim 1, wherein said curved element is adapted to terminate below said fingernail.

3. The adjustable finger stylus of claim 1, wherein the inner surface of said curved element includes at least one protrusion extending inwardly and adapted to be in proximate touching relationship with said fingertip.

4. The adjustable finger stylus of claim 1, wherein said at least one finger engaging element further comprises a feature selected from the group consisting of at least one area of reduced cross-sectional thickness, a flexible area and a combination of at least one area of reduced cross-sectional thickness and a flexible area.

5. The adjustable finger stylus of claim 4, wherein said longitudinal element comprises one adjustable, flexible finger engaging element extending outwardly from each side of said longitudinal element, wherein each of said finger engaging elements is sized to form said contiguous ring-like structure in overlapping arrangement.

6. The adjustable finger stylus of claim 5, wherein one of said finger engaging elements further comprises at least one male stud and the other finger engaging element further comprises at least one female receptor hole.

7. The adjustable finger stylus of claim 5, wherein one of said finger engaging elements further comprises hook material and the other finger engaging element further comprises loop material.

8. The adjustable finger stylus of claim 1 comprising one flexible, adjustable finger engaging element extending outwardly from one side of said longitudinal element.

9. The adjustable finger stylus of claim 8 wherein said flexible, adjustable finger engaging element further comprises an element selected from the group of paired elements consisting of: (i) studs and holes; (ii) hooks and loops; (iii) buttons and holes; (iv) snap together elements; (v) magnetic strips; (vi) angular ridges and teeth; (vii) permanent adhesives; and (viii) semi-permanent adhesives.

10. The adjustable finger stylus of claim 9 wherein said lower surface of said longitudinal element further comprises the second of said paired element corresponding to the paired elements for said flexible, adjustable finger engaging element selected from groups (i)–(v), inclusive, of claim 9.

11. The adjustable finger stylus of claim 9 wherein said lower surface of said longitudinal element and said flexible, adjustable finger engaging element each further comprise permanent adhesive or semi-permanent adhesive. groups (i)–(v) of claim 9.

12. The adjustable finger stylus of claim 8 wherein said finger engaging element further comprises at least one female receptor hole and said lower surface of said longitudinal element further comprises at least one male stud.

13. The adjustable finger stylus of claim 8 wherein said finger engaging element further comprises at least one of hook and loop material and said lower surface of said longitudinal element further comprises the other of said hook and loop material.

14. The adjustable finger stylus of claim 13 wherein said finger engaging element includes loop material and said lower surface of said longitudinal element includes hook material.

15. The adjustable finger stylus of claim 1 wherein engagement of said finger engaging element to said stylus is accomplished using structures selected from the group consisting of studs and receptor holes, material comprising hooks and loops, permanent or semi-permanent adhesive, buttons and holes, snap together elements, magnetic strips, and angular protruding ridges or teeth.

16. The adjustable finger stylus of claim 1 wherein said at least one flexible, adjustable finger engaging element further comprises an element selected from the group of paired elements consisting of: (i) studs and holes; (ii) hooks and loops; (iii) buttons and holes; (iv) snap together elements; (v) magnetic strips; (vi) angular ridges and teeth; (vii) permanent adhesives; and (viii) semi-permanent adhesives.

17. The adjustable finger stylus of claim 16 further comprising a second flexible, adjustable finger engaging element wherein said second flexible, adjustable finger engaging element further comprises the second of said paired element corresponding to the paired elements for said at least one finger engaging element selected from groups (i)–(v), inclusive, of claim 16.

18. The adjustable finger stylus of claim 16 further comprising a second flexible, adjustable finger engaging element wherein said first and second flexible, adjustable finger engaging elements each further comprise permanent adhesive or semi-permanent adhesive.

19. An adjustable finger stylus comprising:

(a) a longitudinal element having an upper surface adapted to be positioned parallel to and in touching contact along a lower surface portion of a user's finger, said finger further comprising a finger tip end having a finger nail, a base end proximate the palm and digits therebetween, and a top surface incorporating said finger nail and a lower surface opposite thereto and extending back from said finger tip, wherein said longitudinal element further comprises a lower surface opposite said upper surface, wherein said upper surface of said longitudinal element curves upwardly from said lower surface portion of a user's finger adjacent said finger tip and terminates proximate said finger nail thereby forming a curved element;

(b) said longitudinal element further comprising at least one flexible, adjustable finger engaging element integral said longitudinal element and having a free end extending outwardly therefrom, said finger engaging element further comprising engagement means to secure said stylus to said finger, wherein engagement of said free end to said stylus forms a contiguous ring-like structure above said upper surface;

(c) a tapered writing extension extending longitudinally from said curved element and forward said finger nail; and (d) wherein said curved element, said tapered writing extension and said at least one flexible, adjustable finger engaging element are formed as a unitary structure.

20. The adjustable finger stylus of claim 19 wherein said engagement means is a pair of elements selected from the group consisting of: (i) studs and holes; (ii) hooks and loops; (iii) buttons and holes; (iv) snap together elements; (v) magnetic strips; (vi) angular ridges and teeth; (vii) permanent adhesives; and (viii) semi-permanent adhesives.

21. The adjustable finger stylus of claim 20 further comprising a second flexible, adjustable finger engaging element wherein said second flexible, adjustable finger engaging element further comprises the second element of said pair corresponding to said engagement means for said at least one finger engaging element and selected from groups (i)–(v) of claim 20.

22. The adjustable finger stylus of claim 20 further comprising a second flexible, adjustable finger engaging element wherein said engagement means for each finger engaging element is a permanent adhesive or wherein said engagement means for each finger engaging element is a semi-permanent adhesive.

* * * * *

UNITED STATES PATENT AND TRADEMARK OFFICE

CERTIFICATE OF CORRECTION

PATENT NO. : 6,533,480 B2
DATED : March 18, 2003
INVENTOR(S) : Marc L. Schneider It is certified that error appears in the above-identified patent and that said Letters Patent is hereby corrected as shown below:

Title page,
Item [57], ABSTRACT,
Line 3, "PAD" should read -- PDA --.

Column 1, line 1 throughout Column 10, line 2,
All occurrences of "PAD" should read -- PDA --.

Figure 8:
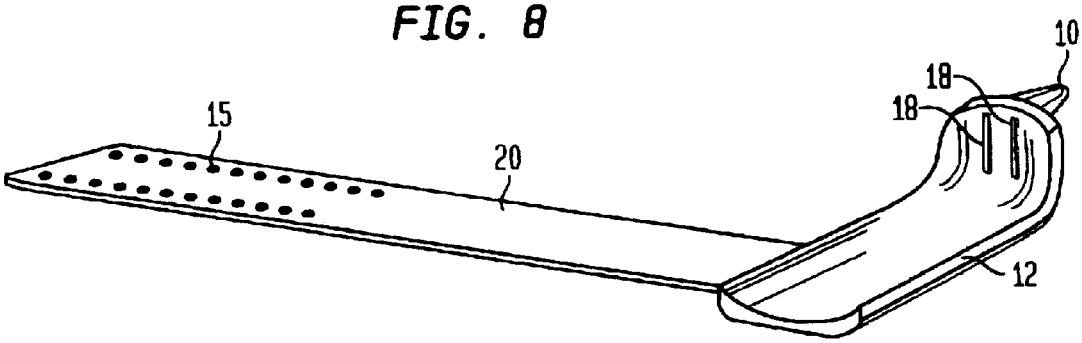
FIG. 8 is a back elevational view of FIG. 6 with the single band disengaged.
Figure 10:
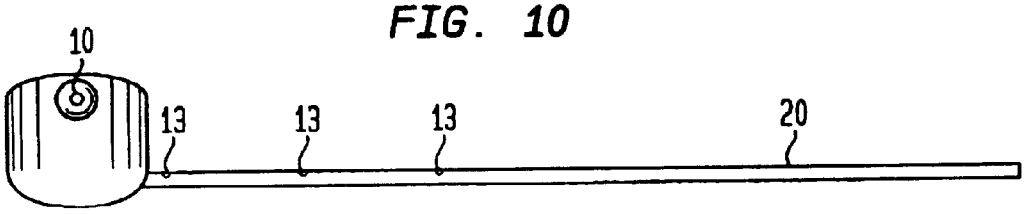
FIG. 10 is a front view of FIG. 8.
Figure 11A:
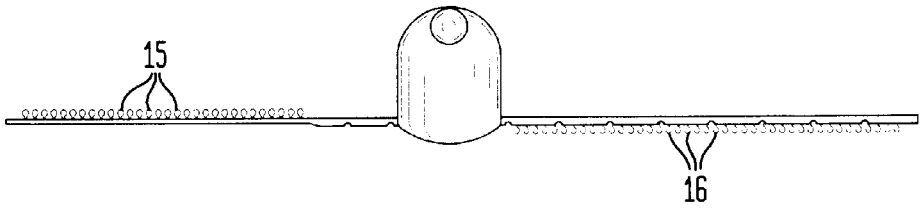
Figure 11B:
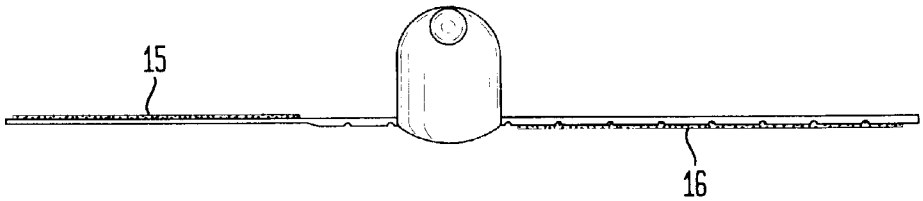
Figure 11C:
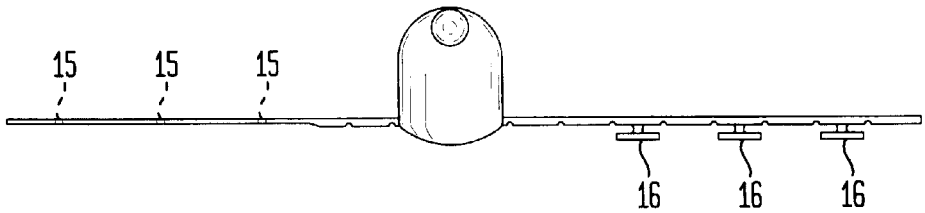
Figure 11D:
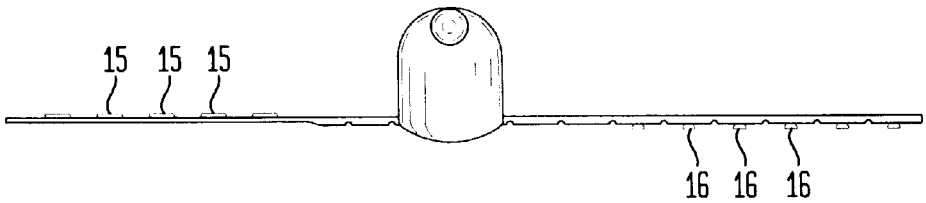
Figure 11E:
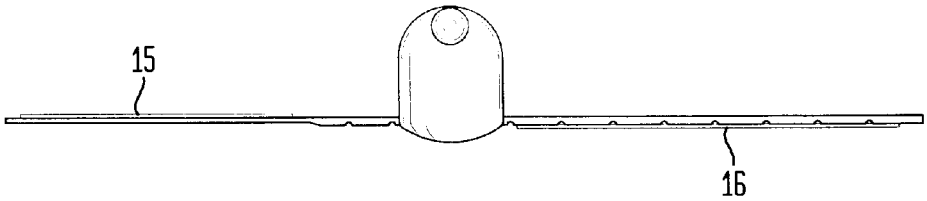
Figure 11F:
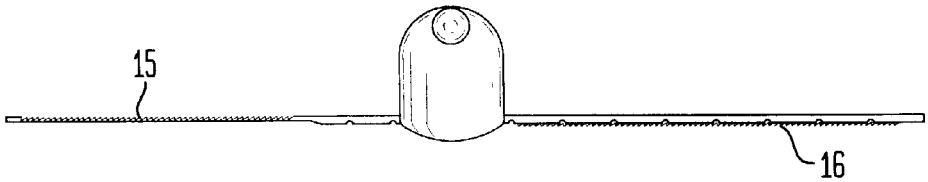
Figure 12A:
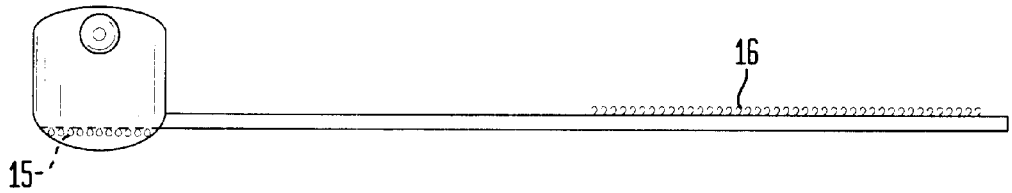
Figure 12B:
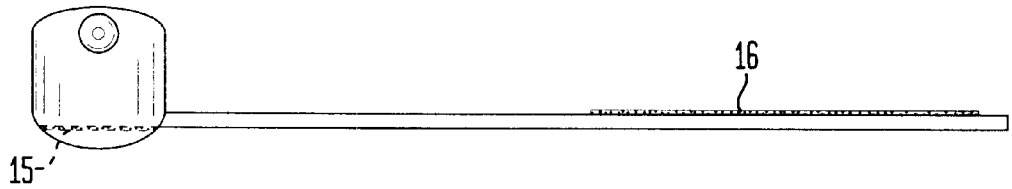
Figure 12C:
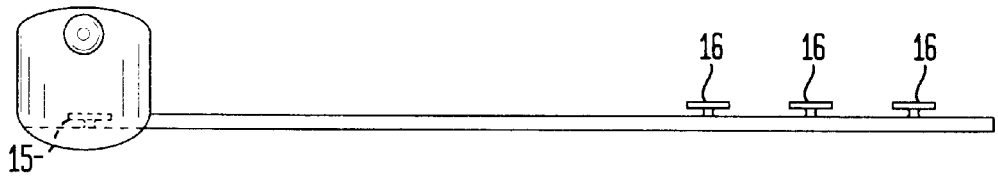
Figure 12D:
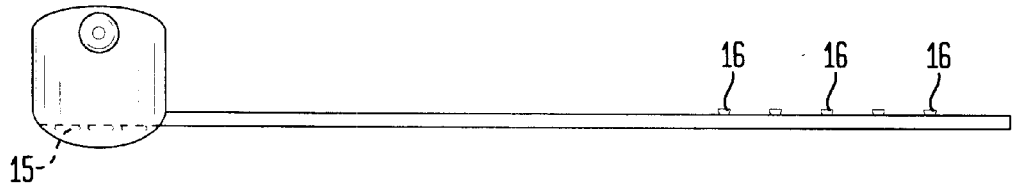
Figure 12E:
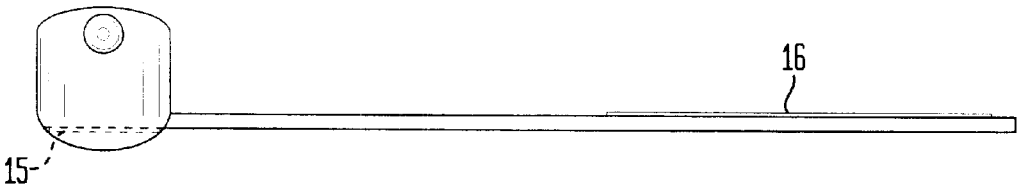
Figure 12F:
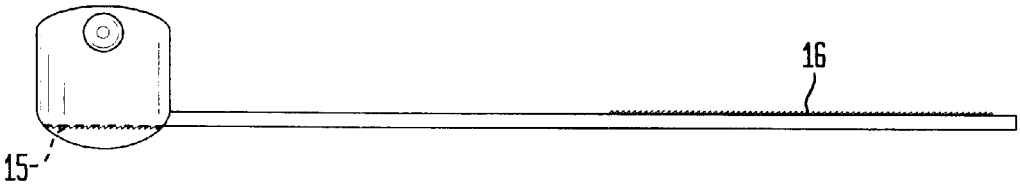

Column 3,
Line 31, after "FIG. 10 is a front view of FIG. 8." insert the following paragraphs:

--FIGS. 11A-F are front views of FIG. 3 illustrating alternative structures for linking two finger engaging elements to one another.

FIGS. 12A-F are front views of FIG. 8 illustrating alternative structures for linking a single finger engaging element to the stylus.--

Column 5,
Line 23, after "...ridges at 16 and 15." insert the following paragraphs:

--A band is preferably structured to include one or more areas of reduced transverse cross sectional thickness in order to function as a hinge point and facilitate bending of a side band to form a loop around the finger. Such areas of reduced cross section, or bending lines, are illustrated at 13 in the figures. In FIGS. 3, 4 and 5, element 20 is shown with eight bending lines, whereas element 14 has two. Located at 19 in these figures is an optional transition area leading to a thinner region of element 14 to further improve flexibility. Selection of the number of bending lines and the use of a transition area depends on the thickness chosen for the side band and the stiffness of the material from which it is constructed. Using limited experimentation, one skilled in the art can readily determine whether to employ such features and, if so, the number and depth of such features. For example, if the band is sufficiently thin and the composition sufficiently flexible, it may be feasible to forgo the use of a bending line and/or a transitional area leading to a region of reduced thickness.

When two bands or finger engaging elements are employed it is not necessary that each be the same length. In fact, it is preferred that in the case where studs and holes are used to link the bands, that the band containing the studs be shorter and contain fewer studs than there are corresponding holes. The use of a shorter band containing the studs can facilitate alignment of the studs with the holes when engaging the two bands. In contrast, differential band length may not be necessary when using hook and loop material since precise alignment is not required to effect engagement. Although FIGS. 4 and 5 illustrate the use of six studs it is to be understood that fewer studs can be used provided that secure engagement is achieved, e.g., as few as two studs can be used and the length of the band in which the studs are present can be reduced accordingly. Similarly, it may be convenient to include a greater number of studs that are spaced closer together and, correspondingly, more holes in the other band, in order to facilitate closer sizing of the stylus to the finger. When two bands are employed, the length of each of the finger engaging elements can be from about 0.75 to about 1.75 inches; preferably from about 0.8 to about 1.6 inches; more preferably from about 1.0 to about 1.5 inches; for example, from about 1.05 to about 1.45 inches. When different lengths are employed for the two bands, the difference can be conveniently selected. For example, it has been found that a difference of 0.375 inches is suitable.

UNITED STATES PATENT AND TRADEMARK OFFICE

CERTIFICATE OF CORRECTION

PATENT NO. : 6,533,480 B2
DATED : March 18, 2003
INVENTOR(S) : Marc L. Schneider It is certified that error appears in the above-identified patent and that said Letters Patent is hereby corrected as shown below:

Column 5 (cont'd),

The width of a finger engaging element or band is not critical, but it is preferred that it be no wider than the finger digit around which it is wrapped; preferably narrower than such digit; more preferably as wide as is necessary in order to receive the holes and studs, or hook and loop material, or other such engagement means as is employed in order to securely engage the stylus to the finger. For example, a band can be about 0.25 to about 0.5 inches wide; preferably about 0.28 to about 0.45 inches wide; more preferably about 0.33 to about 0.40 inches wide; for example about 0.375 inches wide.

When present, the bending hinges 13 and the thinned area 19 facilitate the motion illustrated at 21 in FIG. 3 to create a ring-like form, completed as illustrated in FIGS. 1, 2, 6 and 7. Engagement of the stylus to the finger is accomplished by bending and rotating the side bands 20 up and over the top surface of the finger, preferably with the band containing the studs closest to the top surface of the finger, aligning studs with corresponding holes when the band is in close proximity and preferably comfortably touching the top surface of the finger, pressing the studs into the corresponding holes to lock the two bands, and thereby forming an overlapping ring-like structure.--

Column 7,
Line 51, delete "groups(i)-(v) of claim 9."

Signed and Sealed this

Seventeenth Day of February, 2004

JON W. DUDAS
*Acting Director of the United States Patent and Trademark Office*